US007165912B2

(12) United States Patent
Herzog

(10) Patent No.: US 7,165,912 B2
(45) Date of Patent: Jan. 23, 2007

(54) APPARATUS FOR REBUILDING A SAND BEACH

(76) Inventor: Kenneth H. Herzog, 24661 Seaton Ct. East, Warren, MI (US) 48091

( * ) Notice: Subject to any disclaimer, the term of this patent is extended or adjusted under 35 U.S.C. 154(b) by 0 days.

(21) Appl. No.: 10/937,921

(22) Filed: Sep. 10, 2004

(65) Prior Publication Data

US 2006/0056913 A1 Mar. 16, 2006

(51) Int. Cl.
*E02B 3/04* (2006.01)
*B65B 90/08* (2006.01)

(52) U.S. Cl. ..... 405/25; 405/30; 405/111; 428/34.1; 249/10; 249/18

(58) Field of Classification Search ..... 405/15, 405/21, 22, 25, 29, 30, 110, 111; 404/6; 428/34.1; 249/1, 10, 18
See application file for complete search history.

(56) References Cited

U.S. PATENT DOCUMENTS

| | | | | |
|---|---|---|---|---|
| 3,894,397 | A | 7/1975 | Fair | 405/33 |
| 4,073,145 | A | 2/1978 | Fair | 405/33 |
| 4,172,680 | A | 10/1979 | Brown | 405/16 |
| 4,175,888 | A | 11/1979 | Ijima | 405/31 |
| 4,348,133 | A * | 9/1982 | Trent et al. | 404/6 |
| 4,367,978 | A | 1/1983 | Schaaf et al. | 405/30 |
| 4,479,740 | A | 10/1984 | Schaaf et al. | 405/30 |
| 4,708,521 | A | 11/1987 | Kocourek | 405/31 |
| 4,711,598 | A | 12/1987 | Schaaf et al. | 405/30 |
| 5,564,369 | A * | 10/1996 | Barber et al. | 119/221 |
| 5,586,835 | A | 12/1996 | Fair | 405/30 |
| 6,079,902 | A | 6/2000 | Pettee, Jr. | 405/35 |
| 6,439,801 | B1 * | 8/2002 | Galiana et al. | 404/6 |
| 6,896,445 | B1 * | 5/2005 | Engler | 405/25 |
| 2005/0129468 | A1 * | 6/2005 | Knudson et al. | 405/284 |

* cited by examiner

*Primary Examiner*—Thomas B. Will
*Assistant Examiner*—Tara L. Mayo
(74) *Attorney, Agent, or Firm*—Young Basile

(57) ABSTRACT

A device is provided for preventing shoreline erosion and for rebuilding the sand beach along the shoreline of a large body of water. A series of the devices are placed in side-by-side relation essentially parallel to the shoreline. The device includes a hollow plastic structure fillable with a heavy material, such as cement. The structure has a trapezoidal configuration to lower the center of gravity of the device and includes inclining front and rear walls converging toward each other to the top wall. The hollow plastic structure includes a plurality of tubular members extending from the front wall to the rear wall. The front and rear walls have access apertures opening to the tubular members. The tubular members gradually taper from a predetermined diameter at the access apertures in the front wall to half of the predetermined diameter at the access apertures in the rear wall to reduce the velocity of the flow of water to the large body of water.

17 Claims, 2 Drawing Sheets

APPARATUS FOR REBUILDING A SAND BEACH

FIELD OF THE INVENTION

This invention relates to an apparatus and method for rebuilding a sand beach.

BACKGROUND OF THE INVENTION

Beach erosion is a serious problem along the shores of large bodies of water as a result of wave action in the body of water. Previous structures to control shore erosion include a plurality of block members that are laid end-to-end from each other along the shore line and, further, another plurality of block members on top of the original layer of block members to provide a wall over which the wave action can pass. The wall constructed by this plurality of block members requires connecting components such as locking pins to secure the plurality of blocks together. The construction of the shore erosion control wall of the prior art at the shore line is labor intensive and time consuming.

SUMMARY OF THE INVENTION

It is in the intent of the present invention to address the aforementioned concerns. The invention provides an apparatus for protecting a shoreline and for rebuilding a sand beach along the shoreline floor. The apparatus includes a hollow structure having an essentially trapezoidal configuration with a bottom wall, a pair of sidewalls, an inclined front wall and an inclined rear wall. The front and rear walls converge to a top wall. A plurality of tubular members extends through the hollow structure. Each of the tubular members have access apertures in the front and rear walls. The hollow structure is fillable with cement for retaining the structure in a fixed location on the shoreline floor.

In another aspect of the invention, the hollow structure is made of a water impermeable plastic material for preventing water damage to the structure. In yet another aspect of the invention, the plurality of tubular members may be integrally molded with the plastic hollow structure for receiving and dissipating wave energy.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
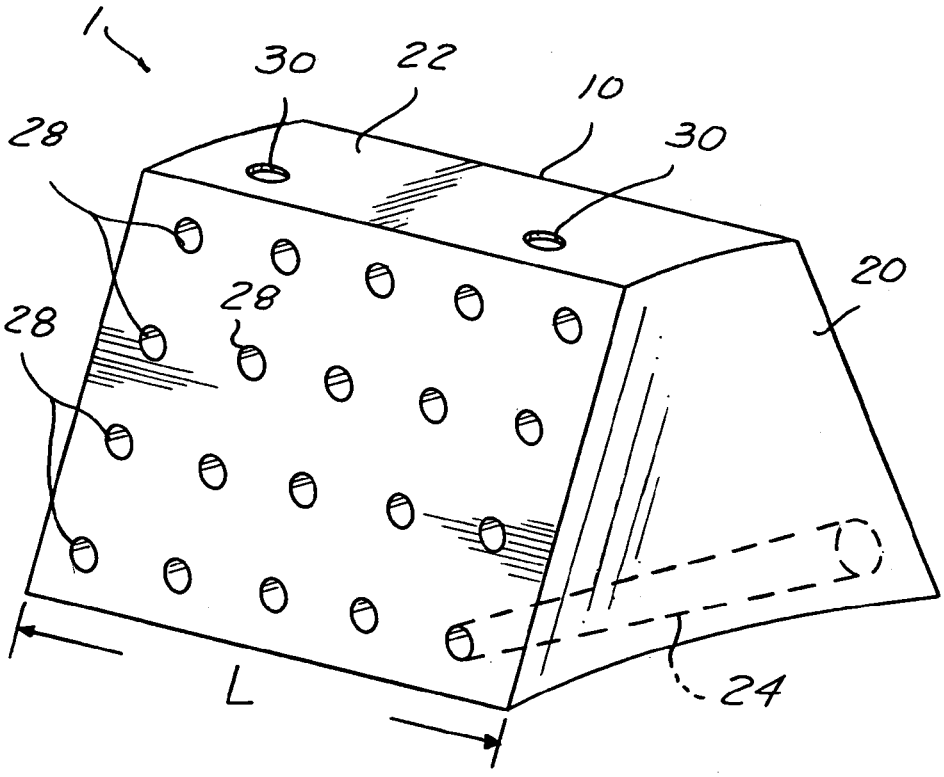
FIG. 1 is a perspective view of an apparatus for rebuilding a sand beach according to the present invention.
Figure 4:
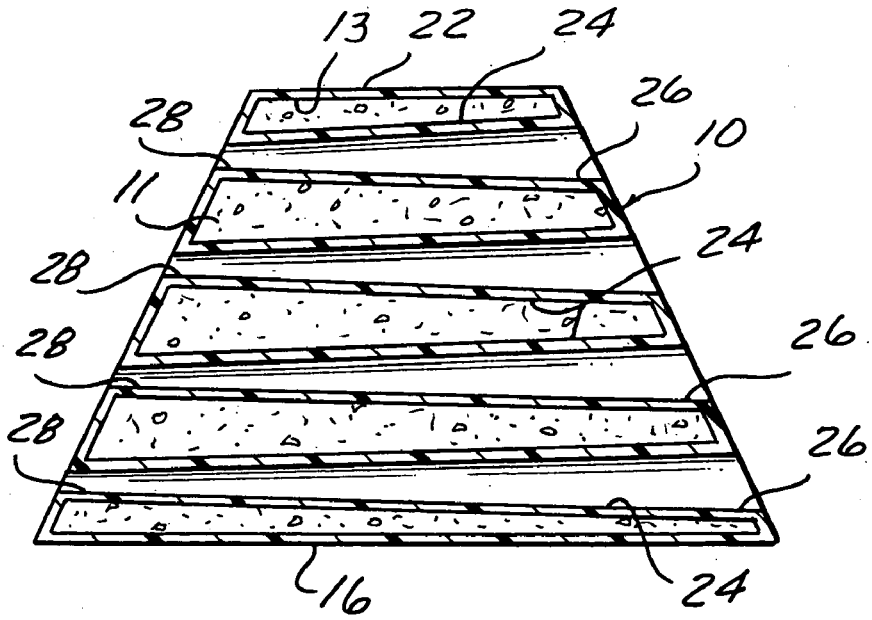
FIG. 4 is a sectional view taken along lines 4—4 of FIG. 3.

FIG. 1 shows a single device or apparatus of the present invention for replenishing beach sand along a shore line. The device 1 includes a hollow structure 10 having a generally trapezoidal configuration and a filler material 11 (as shown in FIG. 4), such as cement disposed within the hollow structure 10, for adding weight and strength to the device 1. The hollow structure 10 has a front wall 12 and a rear wall 14. The front and rear walls, 12 and 14 respectively, extend from an essentially flat bottom wall 16. The front and rear walls 12, 14 each form an inclined surface of the trapezoidal configuration. The front and rear walls 12, 14 converge toward a top planar wall 22 at essentially the same angle. The top planar wall 22 is essentially parallel to the bottom wall 16. The top wall 22 is spaced from the bottom wall 16 by essentially three feet providing the preferred height (H) of the device 1. As seen in FIG. 1, the top wall 22 has a smaller surface area than the bottom wall 16. In the illustrated embodiment, the surface area of the top wall 22 is approximately 40% of the surface area of the bottom wall 16. The bottom wall 16 having a larger surface area lowers the center of gravity of the device 1 to provide stability to the device 1 when encountering incoming wave energy. In the illustrated embodiment, the length of the hollow structure 10 is five feet. The illustrated depth (D) of the hollow structure 10 is also five feet so that area of the planar bottom surface is essentially five square feet. As stated supra, the preferred height (H) of the device 1 is three feet. Of course, the device can have other dimensions. However, the preferred size of the device allows for a structure that can withstand the wave energy, while still allowing for a structure that can be easily transported from one location to another.

Figure 2:
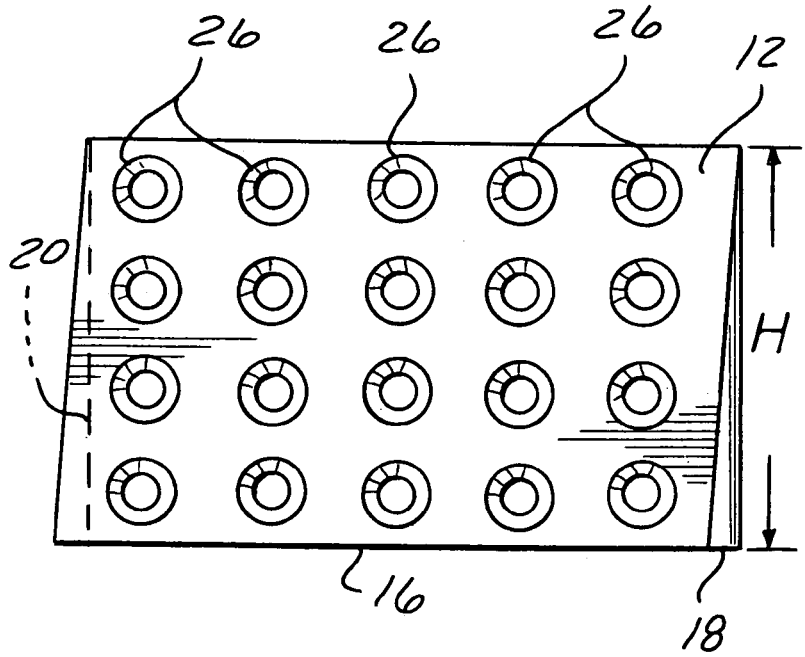
FIG. 2 is an elevational view of the apparatus in FIG. 1 showing a front wall of the structure.
Figure 3:
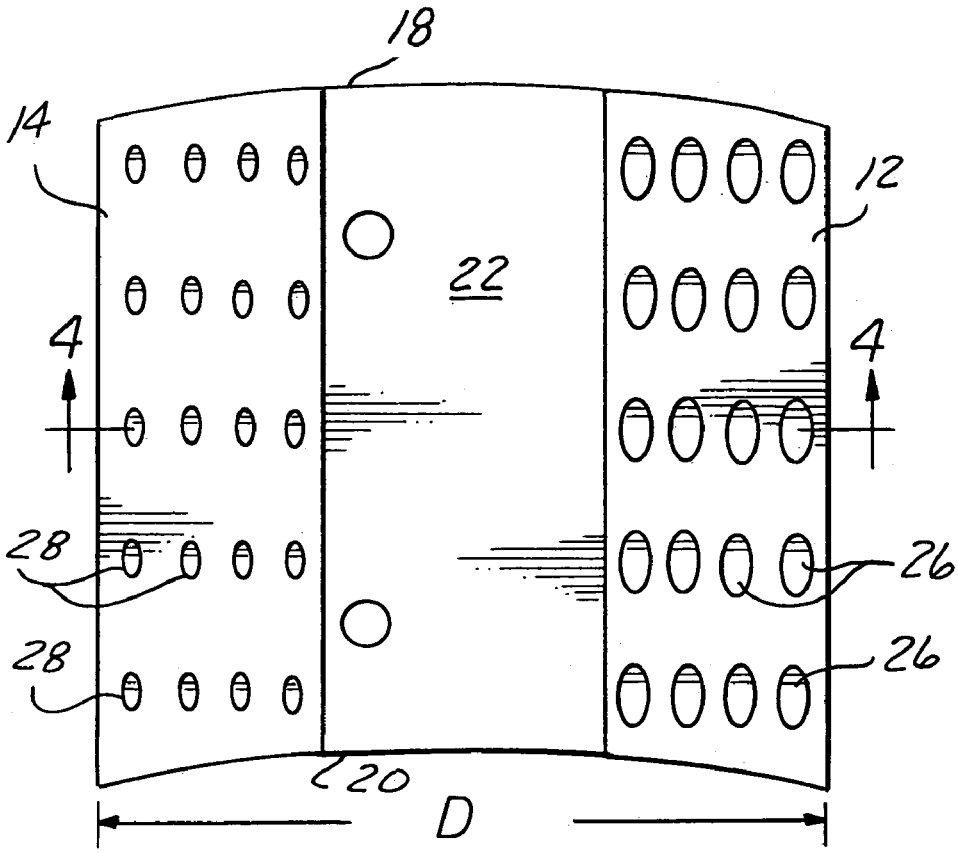
FIG. 3 is a top view of the apparatus.

Integrally formed between the front and rear walls 12, 14 and also extending from the planar bottom wall 16 are two sidewalls 18 and 20. The sidewalls 18, 20 are spaced approximately five feet from each other. The first sidewall 18 has a convex or bowed configuration, as shown in FIGS. 2 and 3. The second sidewall 20 has a concave configuration. Each sidewall 18, 20 has the same radial length so that when at least two devices 1 are placed adjacent to each other, the convex surface of wall 18 aligns within the concave surface of wall 20 of the adjacent device 1. The curvature of the sidewalls 18, 20 is not pronounced. In the illustrated embodiment, the curvature of the sidewalls 18, 20 is based on a circle with a radius of 152.0 inches.

The hollow structure or outer shell 10 is cast from extremely durable and water impermeable polyurethane. The polyurethane outer shell 10 protects the cement 11 or other material therein from dissipation caused by the constant wave action. The hollow structure 10 encloses a cavity 13 therein interrupted by a plurality of tubular members 24 extending from the front wall 12 to the rear wall 14. Each tubular member 24 has a circular cross sectional area. Each tubular member 24 is spaced from an adjacent tubular member 24 providing the hollow space therebetween for the disposition of the cement 11 or other similar material. In the preferred embodiment, as shown in FIGS. 1—3, there are five evenly spaced columns of access holes 26 along the length (L) of the front wall 12 of the device 1. There are also four evenly spaced rows of access holes 26 along the height (H) of the device 1 to provide a total of twenty access holes 26 from the front wall 12 to the corresponding twenty tubular members 24. Likewise, there are corresponding access holes 28 on the rear wall 14. Each access hole 26 on the front wall 12 has a corresponding access hole 28 on the rear wall 14. The access holes 26, 28 define the termination points of each tubular member 24.

The access holes 26 on the front wall 12 opening to the tubular member 24 have twice the diameter of the access holes 28 on the rear wall. In the illustrated embodiment, the diameter of access holes 26 on the front wall 12 is six inches and the diameter of the access holes 28 on the rear wall is three inches. The larger access holes 26 on the front wall receive the initial wave action. As can be seen in FIG. 4, the diameters of the tubular members 24 gradually taper from the six inch diameter of the access holes 26 on the front wall 12 to the three inch access holes 28 on the rear wall 14 to significantly reduce the velocity of the flow of water to the large body of water. The access holes 26, 28 also provide a means for transporting individual devices along the shoreline, since the access holes 26, 28 are spaced and sized to receive the fork of a forklift.

The top planar wall 22 has at least one access aperture 30 into the cavity 13 of the hollow structure 10. The access aperture 30 provides an entry point for filling the cavity 13 with cement 34 to add stability and weight to the device 1 and aids in maintaining the position of the device 1 along the shoreline against the impact of the surf.

The device 1 is intended for placement in the water so that the length (L) is essentially parallel with the shoreline and so that the front wall 12 faces the large body of water and the rear wall 14 faces landward. The orientation of the device 1 forces a portion of the incoming surf to enter the larger access holes 26 on the front wall 12 and to flow through the tapered tubular members 24. The gradual tapered feature of the tubular members 24 restricts the cross-sectional area of the passageway of the tubular member 24 on the rear wall 14 of the device 1. The tapered tubes 24 terminating at reduced access holes 28 in the rear wall 14 along with the incline of the rear wall 14 retards the motion of the return flow of the water toward the sea or ocean. This retarding effect reduces the velocity of the water and causes any suspended sand to be deposited on the shoreward side of the device 1, thereby restoring the height and width of the beach.

To provide restoration to a long stretch of shoreline, a plurality of the devices 1 are placed adjacent to each other so that one sidewall 18 is adjacent to the sidewall 20 of an adjacent device 1. The plurality of devices are orientated so that the front wall 12 with the larger access holes 26 face the large body of water. As discussed supra, one sidewall 18 has a convex or bowed configuration while the opposing sidewall 20 has a complementary concave configuration. The convex surface of the sidewall 18 of one device 1 fits within the concave surface of the sidewall 20 of an adjacent device 1. This configuration of the sidewalls 18, 20 eliminates the use of pins or other locking mechanisms to maintain adjacent devices next to each other. Further, the concave and convex configuration of the sidewalls provides a mean for proper orientation of the device at the site.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for rebuilding a sand beach along a shoreline floor comprising:

a form to be filled with ballast material, defining a shore erosion control wall with flow through passages, said form having an interior cavity disposed therein, said form further having water impermeable outer peripheral walls, and having an essentially trapezoidal configuration, said outer peripheral walls including a bottom wall, a top wall, a pair of sidewalls, an inclined front wall and an inclined rear wall, said front and rear walls converging to the top wall, said form having a plurality of open-ended tubular members extending through the interior cavity of the form and connected to the front wall at one end and connected to the rear wall at an opposite end, defining the flow through passages, wherein said passages are isolated from the interior cavity wherein the plurality of tublar members taper from the front wall to the rear wall for reducing the velocity of inflowing water.

2. The apparatus of claim 1, wherein the tubular members are water impermeable and the outer peripheral walls prevent water access to the interior cavity.

3. The apparatus of claim 2, wherein the plurality of tubular members are integrally molded with the form.

4. The apparatus of claim 1, wherein one sidewall is convex and the other sidewall is concave for providing proper alignment of adjacent structures.

5. The apparatus of claim 4, wherein the radial length of the one sidewall is essentially equal to the radial length of the other sidewall for aligning adjacent forms.

6. The apparatus of claim 1, wherein the open ends of the tubular members in the front wall have a diameter twice the diameter of the open ends of the tubular members in the rear wall and wherein the open ends of the tubular members are access apertures for receiving inflowing water into the flow through passages.

7. The apparatus of claim 6, wherein the ballast material is cement.

8. The Apparatus of claim 7, wherein the access apertures are spaced and sized for receiving a fork of a forklift for transporting the form.

9. An apparatus for rebuilding a sand beach along a shoreline floor, comprising:

a form to be filled with ballast material defining a shore erosion control wall with flow through passages, said form having an interior cavity formed therein, said form having an essentially trapezoidal configuration with a bottom wall, a pair of sidewalls, an inclined front wall and an inclined rear wall, said front and rear walls converging to a top wall; and said form having a plurality of open-ended tubular members extending through the interior cavity of the form and extending from the front and rear walls and, having access apertures in the front and rear walls, said flow through passages defined by the plurality of open-ended tubular members, wherein the flow through passages are fluidly separated from the interior cavity and, wherein the interior cavity is fillable with ballast material wherein the form is made of a water impermeable plastic material for preventing water access to the interior cavity and wherein the top wall has through apertures therein for filling the interior cavity with the ballast material wherein the plurality of tubular members taper from wall to the rear wall for reducing the velocity of inflowing water.

10. The apparatus of claim 9, wherein the plurality of tubular members are integrally molded with the form.

11. The apparatus of claim 9, wherein one sidewall is convex and the other sidewall is concave for providing proper alignment of adjacent structures.

12. The apparatus of claim 11, wherein the radial length of the one sidewall is essentially equal to the radial length of the other sidewall for aligning adjacent forms.

13. The apparatus of claim 11, wherein the access apertures in the front wall have a diameter twice the diameter of the opposing access aperture in the rear wall for reducing the velocity of the flow of water therein.

14. An apparatus for rebuilding a sand beach along a shoreline floor, comprising:

a form to be filled with ballast material defining a shore erosion control wall having an interior cavity formed and enclosed therein, said form having water impermeable outer peripheral walls and having an essentially trapezoidal configuration, said peripheral walls including a bottom wall, a top planar wall, a pair of sidewalls, an inclined front wall and an inclined rear wall, said front and rear walls converging to the top wall, said form having a plurality of open-ended tubular members extending from the front wall, through the interior cavity to the rear wall, the plurality of tubular members having access apertures in the front and rear walls; external fluid through pathways extending from the front and rear walls through the plurality of open-ended tubular members, wherein the through pathways are fluidly separated from the interior cavity and the top wall has an access port open to the interior cavity for filling the interior cavity with ballast material while leaving the through pathways open between the front and rear walls for receiving inflowing water wherein the plurality of tubular members taper from the front wall to the rear wall, and wherein the apertures in the front wall have a diameter twice the diameter of the opposing apertures in the rear wall for reducing the velocity of the flow of water therein.

15. The apparatus of claim 14, wherein the plurality of tubular members are integrally molded with the form at the front and rear walls.

16. The apparatus of claim 14, wherein the top planar wall is essentially parallel to the bottom wall.

17. The apparatus of claim 14, wherein each tubular member is spaced from an adjacent tubular member and the access apertures in the tubular members are spaced and sized for receiving a fork of a forklift for transporting the apparatus.

* * * * *